United States Patent [19]

Vance

[11] Patent Number: 4,473,983

[45] Date of Patent: Oct. 2, 1984

[54] ANCHORING REFRACTORY MATERIALS TO A REFRACTORY LINING

[75] Inventor: Macy W. Vance, Export Borough, Pa.

[73] Assignee: United States Steel Corporation, Pittsburgh, Pa.

[21] Appl. No.: 243,016

[22] Filed: Mar. 12, 1981

[51] Int. Cl.[3] ..... E04B 1/6

[52] U.S. Cl. ..... 52/378; 110/332; 110/336

[58] Field of Search ..... 52/378, 379, 509, 564, 52/567, 506, 513, 333; 110/331, 336, 338, 332, 333, 337

[56] References Cited

U.S. PATENT DOCUMENTS

| | | | |
|---|---|---|---|
| 524,284 | 8/1894 | Price | 52/333 |
| 916,007 | 3/1909 | Parsons | 52/379 |
| 1,429,682 | 9/1922 | Megenity | 52/379 |
| 1,710,257 | 4/1929 | Haniman | 52/564 |
| 1,848,737 | 3/1932 | Matthews | 110/332 |
| 1,975,759 | 10/1934 | Anderson | 52/379 |
| 2,021,610 | 11/1935 | Quint | 52/379 |
| 3,204,939 | 9/1965 | Ipsen | 110/331 |
| 3,292,333 | 12/1966 | Sandmeyer et al. | 52/509 |
| 3,486,280 | 12/1969 | Bolardi | 52/509 |
| 3,587,198 | 6/1971 | Hensel . | |
| 3,624,733 | 11/1971 | Eadie | 110/335 |
| 4,070,842 | 1/1978 | Fischer . | |

FOREIGN PATENT DOCUMENTS

| | | | |
|---|---|---|---|
| 203478 | 2/1907 | Fed. Rep. of Germany | 52/567 |
| 132287 | 9/1919 | United Kingdom | 52/564 |

*Primary Examiner*—John E. Murtagh
*Attorney, Agent, or Firm*—Rea C. Helm

[57] ABSTRACT

Anchor organization for a layer of refractory material deposited on a refractory furnace lining. The organization includes a number of non-metallic refractory anchors disposed at spaced locations about the furnace lining surface. The anchors are provided with a particular configuration that includes a concave locking surface on each end providing a refractory-retention function. Each anchor has one end cemented into a hole in the lining and the other end immersed in the cementitious refractory material that is deposited on the surface of the furnace lining. A plunger tool is also disclosed for use in inserting the anchor and cement into a hole in the lining.

1 Claim, 5 Drawing Figures

ANCHORING REFRACTORY MATERIALS TO A REFRACTORY LINING

Figure 1:
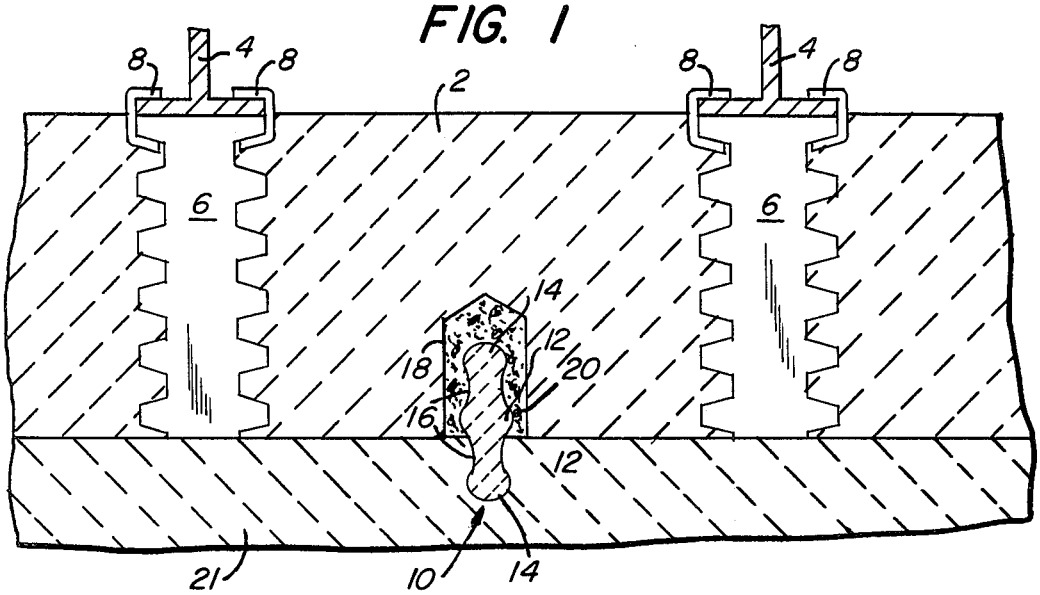

This invention relates to the anchoring of materials to a refractory lining and more particularly to non-metallic refractory materials applied to the interior surface of a furnace that is exposed to high temperatures. As used herein the expressions, "refractory" or "refractories", refer generally to non-metallic materials, commonly referred to as "industrial ceramics".

Furnaces for reheating of steel preparatory to rolling are constructed with dense (greater than 100 pounds per cubic foot) refractory roof and walls. The refractories are preferably shaped in place to make a monolithic lining, but construction requirements may include some segments. The dense refractories have a tendency to spall and these operating conditions create thermal stresses in the refractory lining which increases the tendency of the dense lining to develop cracks, chips and to spall, eventually requiring repairs.

The conventional method of repairing the refractory lining is by the hydraulic gun placement (called "gunniting") of a refractory cement coating or veneer over the worn or damaged portions of the lining. The refractory cement coating may be lightweight, under 100 pounds per cubic foot, or dense, over 100 pounds per cubic foot, and when applied to roof or wall surfaces to depths up to about three inches, as is desirable, may spall as a result of the poor adhesion properties of the coating material when applied to the lining surfaces. Such spalling occurs, in part, as a result of shrinkage that normally occurs in the coating upon drying. The problem is compounded if fracture of the coating occurs, as is common in such material. Spalling may also occur as a result of excessive temperature gradient that typically exists across the thickness of the coating. Additionally, load factors create high-stress areas and these, in combination with the above-mentioned factors operate a peeling stress that operates to pull the coating off the lining. This occurs principally on the furnace roof and even to a lesser extent on the lining of the furnace side walls. It is only through the use of anchoring apparatus that a prolonged life of the lining and/or coating can be obtained.

There are a number of metallic anchoring devices to anchor a refractory coating to a furnace lining, but such anchors are not available for hot-face temperatures exceeding 2000° F. that normally occur in metal reheat furnaces for which the invention is adapted for use. Moreover there is no high-temperature non-metallic refractory anchor currently available that is easily installed on the hot face of an existing furnace roof.

In accordance with the invention, there is provided a non-metallic refractory anchor having a particular structural configuration that includes bulbous ends, a central bulge and concave locking surfaces interposed between the ends and the central bulge, the congifuration being obtained from continuous, arcuately-formed surfaces having no abrupt changes of direction. The anchors are applied to the workface by being inserted into holes drilled in the lining surface. Each anchor and an accompanying amount of cement is inserted with a plunger until the central bulge is disposed at about the lining face, where-upon the hole will be filled with the cement so that when the cement sets, one of the concave surfaces locks the anchor to the lining. Thereafter a refractory coating can be applied to the lining over the projecting end of the anchor and the other concave locking surface serves to lock the coating to the anchor and thereby in retained relation to the surface of the lining.

It is, therefore, an object of the invention to provide a method of anchoring a coating to a refractory furnace lining.

Another object of my invention is to provide a non-metallic anchoring system that is easy to install and resists thermal stresses.

Figure 2:
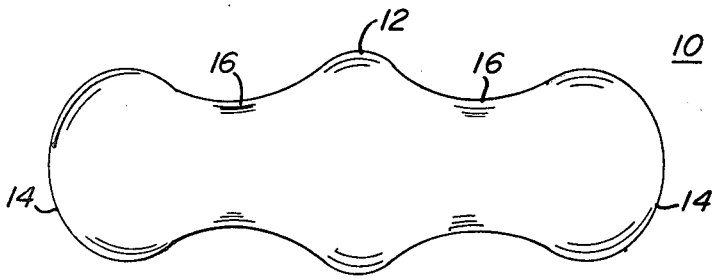
Figure 3:
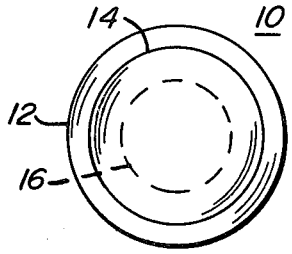
Figure 4:
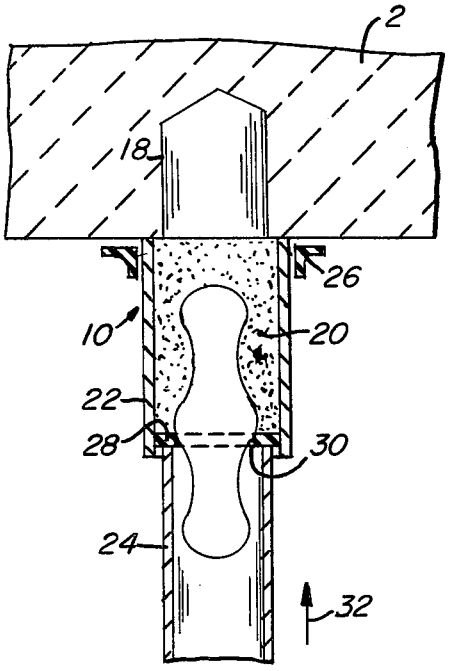
Figure 5:
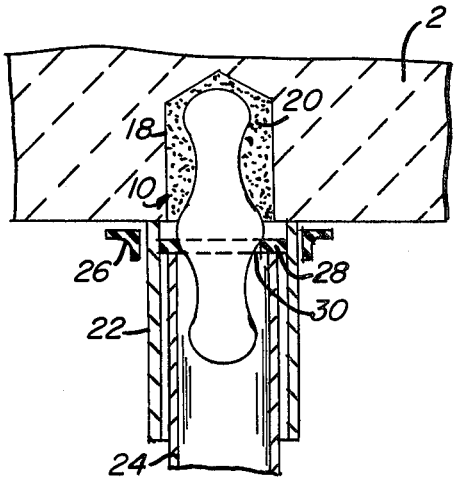

These and other objects will become more apparent after referring to the following specification and drawings in which:

FIG. 1 is a cross-sectional view of part of a furnace roof showing an installed anchor supporting an insulating veneer or coating, FIG. 2 is a side view of the preferred anchor, FIG. 3 is an end view of the preferred anchor, FIG. 4 is a cross-sectional view showing the anchor, anchor cement, and plunger prior to insertion into a part of the furnace roof lining, and FIG. 5 is a cross-sectional view showing the anchor, anchor cement, and plunger after insertion into a part of the furnace roof lining.

Referring now to FIG. 1, reference numeral 2 is a thick layer of relatively dense plastic refractory forming the refractory lining of the reheating furnace roof. Lining 2 is secured to structural I-beams 4 (partially shown) by means of dense fireclay or high-alumina anchors 6 attached to I-beams 4 by metallic hangers 8. This is a typical reheating furnace roof installation, the sidewall linings being connected to a furnace structural frame or continuous steel plate (not shown) in a similar manner.

A refractory anchor 10, constructed according to the invention is shown in FIGS. 2 and 3. As shown, the anchor is generally circular in cross-section, being formed as a surface of revolution defined by rotating a continuously arcuate, generally sinuous line about a longitudinal axis to produce a body having a center bulge section 12, a bulbous section 14 on each end and a concave surface locking section 16 between center bulge section 12 and each bulbous end section 14. As shown in FIG. 1, anchor 10 is applied to the lining 2 by having one end inserted in a hole 18 in lining 2 bored up to about the center bulge section 12. The end is held in place in the hole 18 by a quantity of light weight fine grained calciumaluminate cement 20 inserted with the anchor into the refractory lining 2. The other end of the anchor extends from the surface of the refractory lining 2 and is adapted to retain an insulating refractory coating 21 is deposited on the surface of the lining 2 after the anchors 10 have been installed.

Referring now to FIG. 4 and FIG. 5, there is shown the particular apparatus employed for installing the anchors 10 into holes 18 bored into the surface of lining 2. In the figures reference numeral 22 is a hollow, cylindrical charging tube, and reference numeral 24 is a cylindrical plunger tube which is slidingly received inside charging tube 24. An outer gasket 26 is resiliently retained on the upper end of the charging tube. An anchor retention mount 28 fits inside charging tube 22, resting on top of plunger tube 24. The mount 28 is a washerlike member having a hole 30 slightly smaller than the center bulge section 12 of anchor 10 for retaining the anchor within the applicator apparatus.

To install the anchor, a hole 18 is first drilled into lining 2. Hole 18 does not need to pass through lining 2, but assuming a lining of between 9 and 13 inches thick, and anchor 10 about 4 inches long with the central bulge about $1\frac{3}{8}$ inches in diameter, hole 18 would be preferably $1\frac{1}{2}$ inches in diameter and about three inches deep. A rotary hammer drill, or impact drill with a carbide tipped bit is a satisfactory tool for drilling the hole, but any method is satisfactory to provide a receptacle for anchor 10 and cement 20.

An anchor 10, mount 28 and tubes 22 and 24 are coaxially assembled as shown in FIG. 4. The inner diameter of tube 22 is preferably just slightly larger than hole 18. Tube 24 telescopically fits inside tube 22, and mount 28 placed on the upper end of tube 24. Mount 28 is preferably formed of waxed cardboard or, alternatively, of hard rubber or plastic and may be split for easy removal from the tube 22. Anchor 10 is placed in hole 30 of the mount 28, the hole 30 being slightly smaller than center bulge section 12 so as to position the anchor in substantial coaxial relation with the tube 22. Outer gasket 26, of any convenient resilient material, is placed over the end of tube 22 to be retained thereon by the resilient nature of the gasket. The cavity in tube 22 is then filled with a light weight finegrained fireclay castable 20, such as a calcium-aluminate cement. The applicator assembly is then positioned over bore hole 18 and plunger tube 24 moved in the direction of arrow 32 which extends the leading end of the anchor 10 and, simultaneously therewith, the cement into the hole 18 thereby placing the anchor and cement in the position shown in FIG. 5. The position of gasket 26 against the surface of liner 2 prevents leakage as plunger tube 24 and mount 28 press the castable cement 20 and anchor 10 into hole 18. The applicator assembly is then removed from the face of the lining 2 leaving the mount 28 resiliently attached to the anchor.

Cement 20 employed in the installation should be viscous enough to be self-supporting when anchor 10 is inserted into hole 18. The porosity of lining 2 creates a capillary action, drawing water out of cement 20 to improve its staying power while the cement hardens. It has been found that pre-wetting the hole may be necessary if the refractory 2 is too porous. When the cement has set, mount 28 can be removed and discarded.

The description and drawings have shown the placement of a single anchor in a furnace roof. However, if a large roof area, or the entire roof area is to be covered, a plurality of anchors are used, generally on spacing of between six and twelve to eighteen inches apart. Furnace sidewalls, except portions of the high walls, rarely require anchoring. When anchors are required on the side walls, they are inserted in the same manner and spaced apart about the same as described for the furnace roof.

After the anchors are set in place but before coating is applied to the furnace lining, the lining should be cleaned and any deposits or loose crumbly materials removed. Since gunning light weight (for example a calcium aluminate cement with coarse aggregate weighing 60 pounds per cubic foot) material requires a careful water mix, it is important that the surface porosity be considered in attempting to make a maximum bond. If the anchors are inserted into the lining the same distance, they provide an excellent gauge for measuring the coating thickness as the material is applied. The coating material is applied by gunniting as referred to above, the deposition of material being to a depth typically of about three inches. A coating 21 of this thickness will, as shown in FIG. 1, completely envelope the anchors 10. In filling the space created by the concave surface 16 that extends below the surface of lining 2 the coating material is caused to be vertically supported by the protruding end 14 of the anchor.

Anchor 10 is composed of a refractory material having suitable hot strength and is designed to secure the coating to the original furnace lining. Generally, a finegrained, high-alumina or mullite composition, containing from 40% to 95% alumina and the balance silica is a preferred material for forming the anchor 10. It may be cast or pressed to shape and is prefired. Formation of the anchor with bulbous ends and of a shape that is completely arcuate in nature minimizes the establishment of unequal stresses in the anchor. The concave surfaces operate to effectively lock the anchor to the coating and to the original furnace lining and the bulging center section, while completing the concave sections, tends to hold the cement 20 in place during insertion of the anchor and setting of the cement.

The anchoring system is useful in any high-temperature installation where it is not possible to use metal anchors. The system will stand severe service and will last for many heating-cooling cycles.

I claim:

1. The combination including:

a refractory base;

a generally cylindrical bore in said base;

an anchor for reception in said bore comprising:

a body of refractory material formed as a surface of revolution defined by rotation about an axis of a continuously arcuate, substantially sinuous line having convex protuberances at the end and midpoint thereof and concave recesses intermediate said protuberances;

said anchor being received in said bore to an extent locating one of said concave recesses in said bore and the other of said concave recesses exteriorly of said bore;

a body of cement filling said bore about said refractory body; and a layer of refractory material applied to the exterior of said refractory base in contiguous, surrounding relation to the portion of said refractory body that is exterior of said refractory base.

* * * * *